US006488551B1

(12) United States Patent
Tomlin et al.

(10) Patent No.: US 6,488,551 B1
(45) Date of Patent: Dec. 3, 2002

(54) PRESS-FIT JUNCTION BOX TERMINAL

(75) Inventors: Jeromy William Tomlin, Berkley, MI (US); Roderick Rhys Jenkins, Canton, MI (US); Jerome Adam David Duhr, Westland, MI (US)

(73) Assignee: Yazaki North America

( * ) Notice: Subject to any disclaimer, the term of this patent is extended or adjusted under 35 U.S.C. 154(b) by 0 days.

(21) Appl. No.: 09/956,293

(22) Filed: Sep. 19, 2001

Related U.S. Application Data

(63) Continuation of application No. 09/641,274, filed on Aug. 17, 2000, now abandoned.

(51) Int. Cl.[7] ..... H01R 4/48
(52) U.S. Cl. ..... 439/860; 439/949; 439/47
(58) Field of Search ..... 439/860, 76.1, 439/949, 225, 883, 45, 47, 48

(56) References Cited

U.S. PATENT DOCUMENTS 4,208,080 A * 6/1980 Teagno ..... 439/45
4,567,654 A * 2/1986 Kloenne et al. ..... 439/45
5,082,463 A 1/1992 Saimoto ..... 439/883
5,223,676 A 6/1993 Yamamoto et al. ..... 174/250
5,434,749 A 7/1995 Nakayama ..... 361/775
5,556,285 A * 9/1996 Ono ..... 439/74
5,722,851 A * 3/1998 Onizuka et al. ..... 439/404

FOREIGN PATENT DOCUMENTS

JP 08-172447 * 1/1998

* cited by examiner

*Primary Examiner*—Javaid Nasri
(74) *Attorney, Agent, or Firm*—Young & Basile

(57) ABSTRACT

A flat (horizontal) press-fit busbar terminal structure for use in junction boxes, power distribution boxes, and the like at vehicle wiring junctions. Instead of the usual vertical busbar terminal extending through one or more insulation plate layers to be connected to the vertical terminals of a pluggable component, flat press-fit terminals are fastened in horizontal, essentially flush fashion to the surfaces of the flat insulation plates, with horizontally disposed terminal ends for receiving pluggable component terminals therethrough in perpendicular fashion. The flat terminals of the invention greatly reduce the overall height of the junction box, PDB, etc., thereby allowing the vertical component terminals to be used in place of peripheral jumper connections to interconnect one or more layers of busbar terminals.

5 Claims, 6 Drawing Sheets

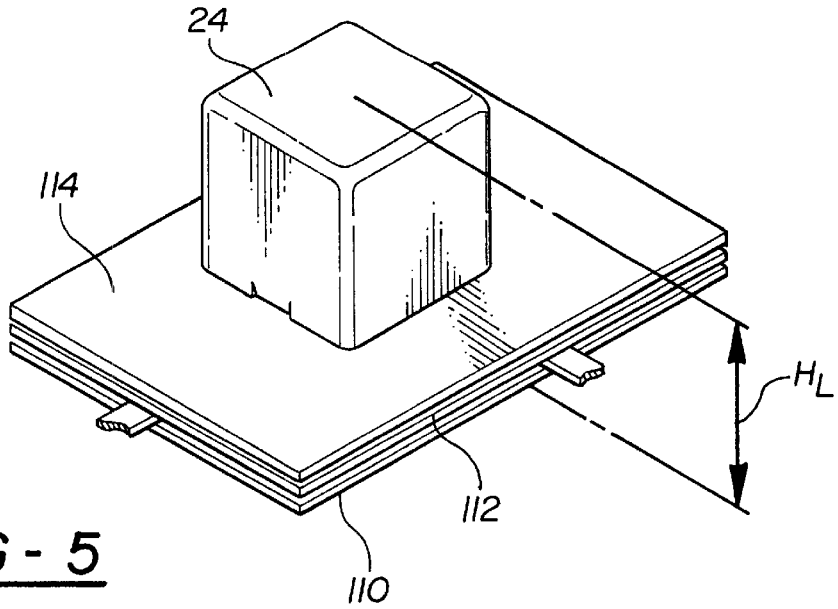
FIG - 5
FIG - 6A
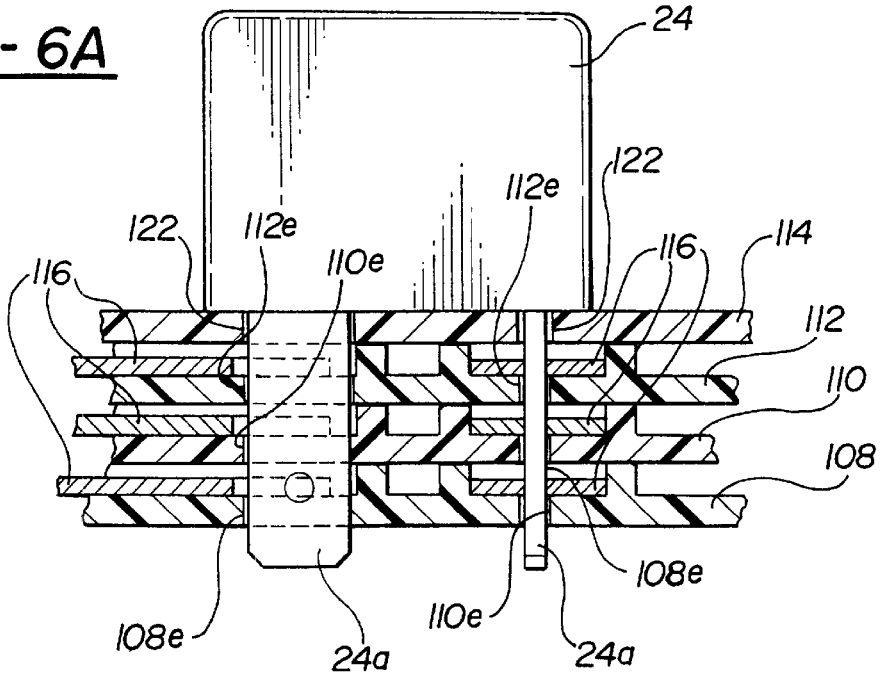

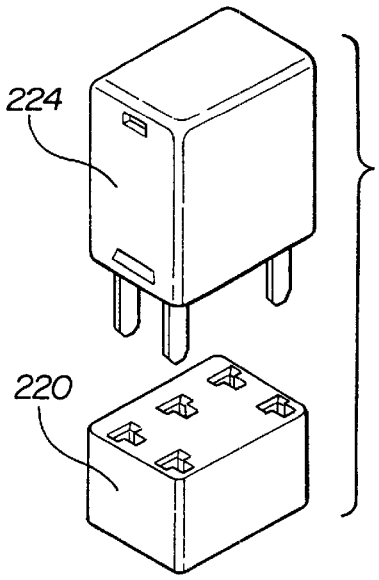
FIG-7
PRIOR ART
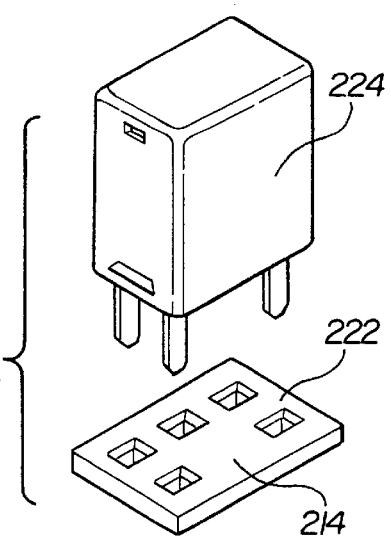
FIG-7A
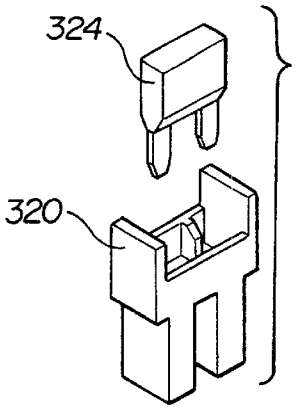
FIG-8
PRIOR ART
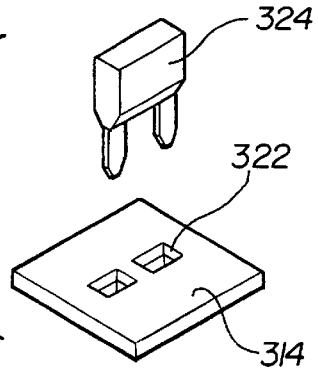
FIG-8A
FIG-9
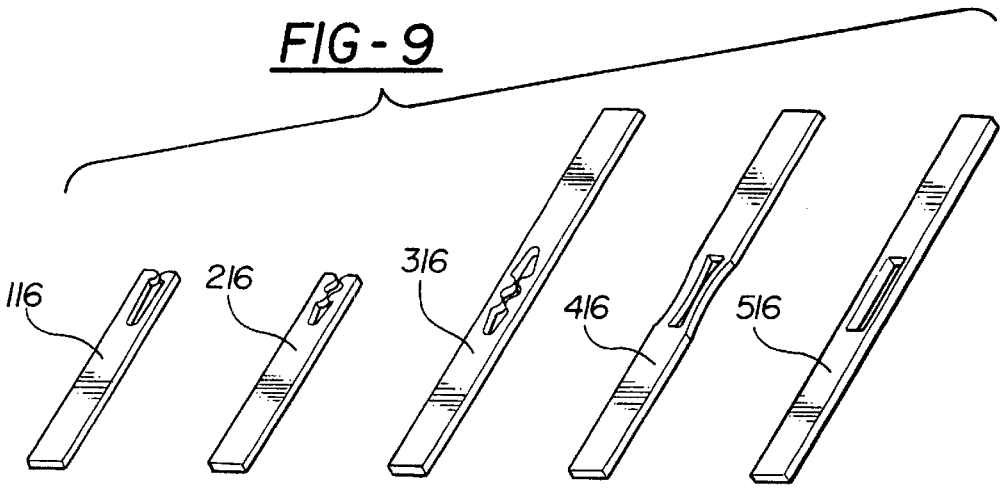

PRESS-FIT JUNCTION BOX TERMINAL

RELATED APPLICATIONS

This application is a continuation of U.S. patent application Ser. No. 09/641,274 filed on Aug. 17, 2000 now abandoned, and is incorporated herein by reference in its entirety.

FIELD OF THE INVENTION

The present invention is in the field of vehicle junction box busbar terminals.

BACKGROUND OF THE INVENTION

Current press-fit busbar terminals in vehicle junction boxes are provided as vertical arms, adapted to receive mating terminals from components plugged into the junction box, such as mini-fuses, relays, and the like. The vertical arrangement of the press-fit terminals allows the vertically oriented component terminals to be mated in an axial press-fit. However, junction boxes are becoming increasingly crowded, with more components required for more complex vehicle systems. The vertical press-fit terminals and their associated covering structure tend to give the junction box an overall height which is undesirably large for current vehicle packaging requirements.

The upper ends of other types of vertical terminals often require the addition of female-female terminal adapters housed in "pedestal" structure to provide adequate electrical and mechanical connection with the component terminals. These adapters and their pedestals further increase height, as well as cost and complexity.

Junction boxes typically contain several stacked layers of busbars and insulation plates, resembling a sandwich. Busbars on lower-level insulation plates penetrate through slots in upper layers of insulation plates into uppermost structure such as a relay pedestal in order to receive a component plugged into the junction box. It is often necessary to provide "jumper" connections between different layers of busbars and insulation plates, achieved by providing electrical connections between busbar ends protruding from the edge of the busbar/insulation plate sandwich. These jumper connections add further complexity to the junction box and are relatively expensive.

Another problem with current press-fit busbar terminals is that they inherently waste metal. Only the terminal end of the vertical leg portion actually makes electrical connection; the remainder simply gives the terminal end enough height to reach the connection.

SUMMARY OF THE INVENTION

The present invention is a flat (horizontal) press-fit busbar terminal that lies flat against an associated insulation plate in a junction box. The terminal end of the busbar is slotted to receive the blade-like male terminals of junction box components such as micro-relays, mini-fuses, iso-relays, and the like in a press-through friction fit. The terminal end is accordingly located over a slot-like blade receiving aperture in the insulation plate. The vertical component terminal itself can function as a layer-to-layer "jumper" passing through the terminal ends of two or more inventive flat terminals on stacked insulation plate layers.

The invention greatly reduces the overall height of the junction box by eliminating the need for protruding plastic structures such as relay pedestals from the inner terminal cover. The amount of busbar material is also reduced by using the vertical connector from the electrical component as the extension needed to reach a particular electrical connection on a particular insulation plate layer.

Several different possible embodiments of flat press-fit terminals are illustrated, although it has been discovered that the basic two-fingered slotted terminal in common vertical use can be used in flat (horizontal) fashion in the present invention and still provide connection with the vertical component terminals in a simple press-fit insertion.

These and other features and advantages of the invention will become apparent upon further reading of the specification in light of the accompanying drawings.

BRIEF DESCRIPTION OF THE DRAWINGS

FIG. 5 illustrates the height of the inventive junction box structure of FIG. 3 fully assembled.

FIG. 6A is a side section view of the jumper arrangement of FIG. 6, fully assembled.

FIGS. 7 and 7A are a side-by-side comparison of a prior art relay and pedestal structure (FIG. 7) and a pluggable relay receptacle using terminals according to the present invention (FIG. 7A).

FIGS. 8 ad 8A are a side-by-side comparison of a prior art fuse and fuse holder structure (FIG. 8) and a pluggable fuse receptacle using flat press-fit terminals of the present invention (FIG. 8A).

FIG. 9 illustrates several alternate embodiments of flat press-fit terminals according to the present invention.

DETAILED DESCRIPTION OF THE ILLUSTRATED EMBODIMENTS

Figure 1:
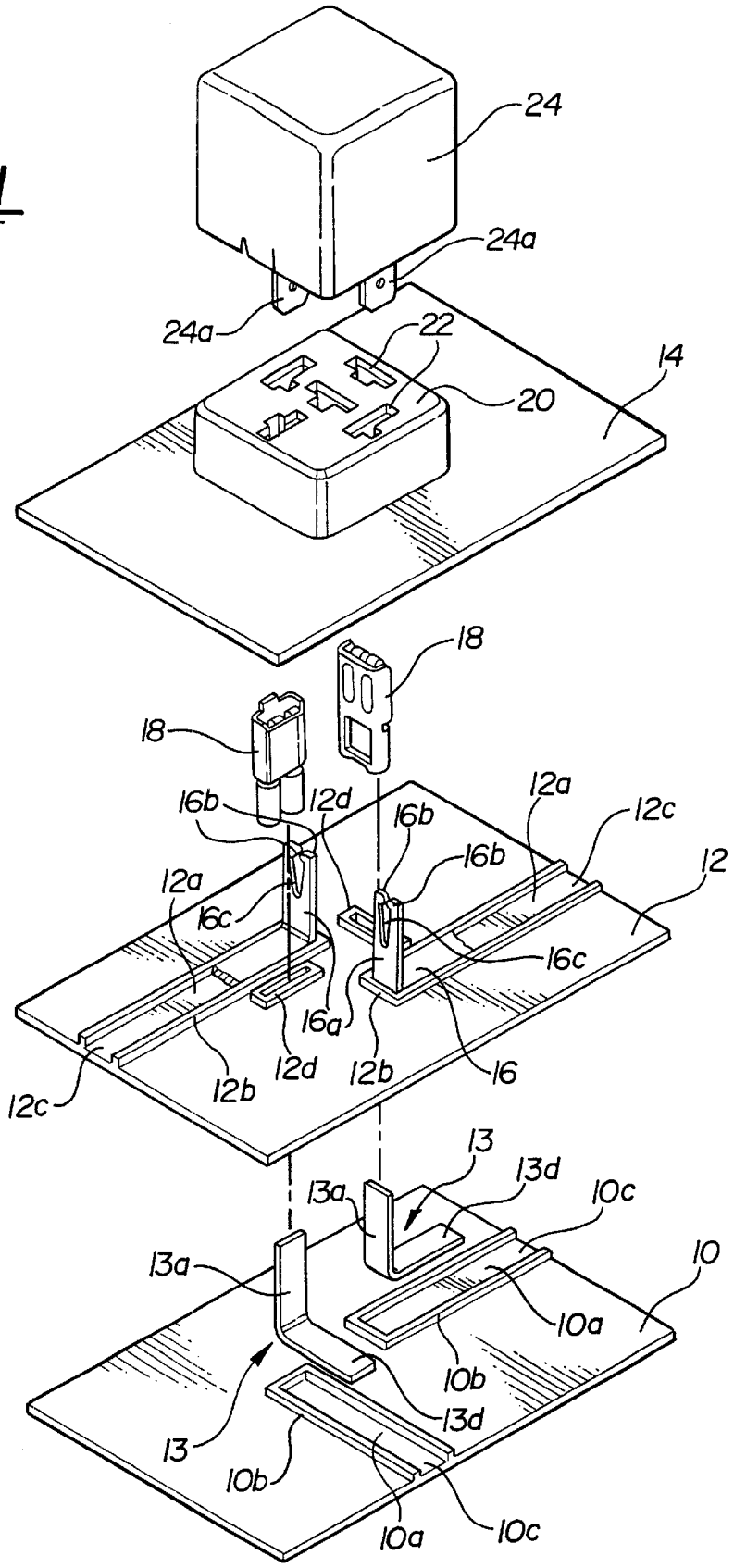
FIG - 1 PRIOR ART
FIG. 1 is an exploded perspective view of a prior art junction box arrangement using vertical press-fit terminals with female-female adapters and relay pedestal structure.

Referring first to FIG. 1, a portion of a prior art junction box terminal assembly comprises plastic insulation plates 10, 12 layered underneath an inner cover 14 (also made from an insulating material such as plastic). A plurality of a first type of vertical terminal 13 is shown mounted on the lowermost insulation plate 10, with solid, vertical legs 13*a* extending up through terminal slots 12*d* and plate 12 into terminal receptacles 22 in a relay pedestal 20 formed on the upper surface of cover 14. The illustrated embodiment of FIG. 1 shows the use of female-female adapters 18 of a type commonly found in the pedestal structure to provide mechanical and electrical connection between solid terminals 13 and the flat, blade-like plug terminals 24*a* from an electrical component such as a relay 24.

Vertical terminals of the press-fit type are illustrated at 16 on intermediate insulation plate 12. Each has a vertical leg 16*a* with a terminal end for making direct electrical connection to the blade-like terminals 24*a* from a pluggable component such as 24. In the illustrated embodiment the terminal end of vertical leg 16*a* consists of a pair of prongs 16*b* defining a slot 16*c* between them. Vertical terminals 16 are secured to insulation plate 12 with their base legs secured at appropriate locations such as terminal placement channels 12*a* defined by raised ribs 12*b* molded or otherwise formed in the insulation plate. In the illustrated embodiment channels 12*a* extend to the outer edges of insulation plate 12, where they terminate in open ends 12*c* for a purpose described below. It will be understood by those skilled in the art that the base legs of terminal 16 may be secured in known manner to insulation plate 12 and in channels 12*a*, for example adhesively, mechanically, or with a weld.

It will be understood by those skilled in the art that the illustrated junction box structure and terminal arrangement in FIG. 1 is a simplified example of typical terminal structure, in that only four terminals 13, 16 are illustrated for mating with a four-terminal relay component 24. As is understood by those skilled in the art, the prior art arrangement generally shown in FIG. 1 is representative of junction box terminal arrangements wherein terminals are provided on two or more levels of insulation plate, and are adaptable for providing terminal connections for components with two or more terminals.

FIG. 1 is also simplified in that it shows a junction box terminal arrangement for only one pluggable component (relay 24), when a complete junction box will typically provide pluggable busbar connections for many pluggable components such as relays and fuses.

Figure 2:
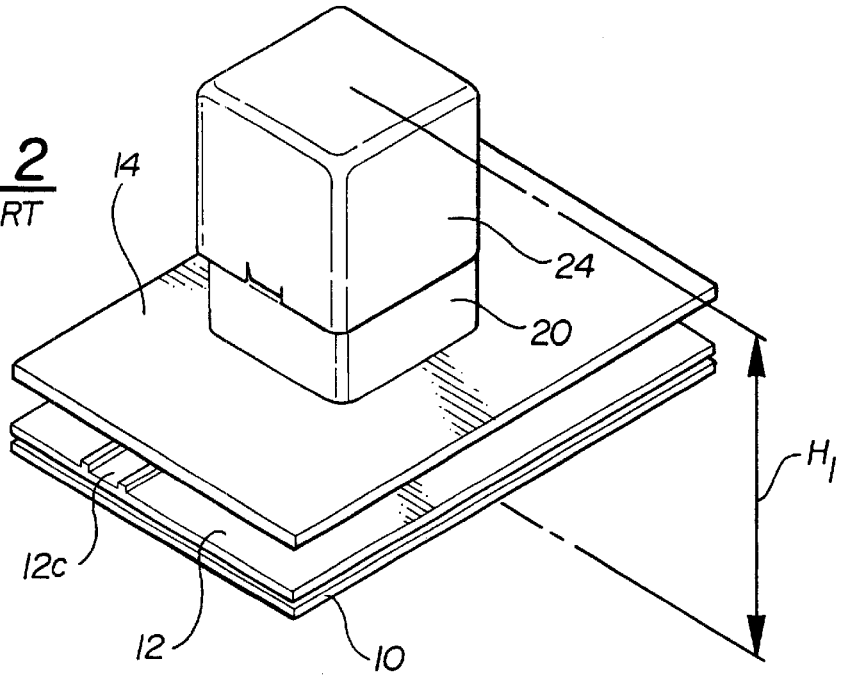
FIG - 2 PRIOR ART
FIG. 2 illustrates the height of the assembled junction box of FIG. 1.
Figure 4:
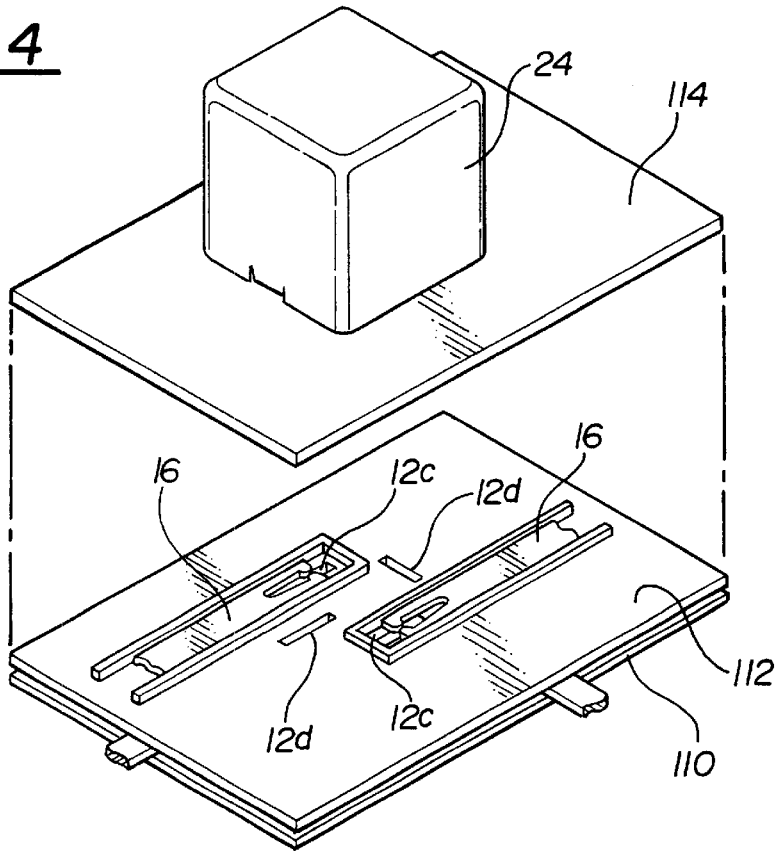
FIG. 4 illustrates the junction box structure of FIG. 3 partially assembled.
Figure 3:
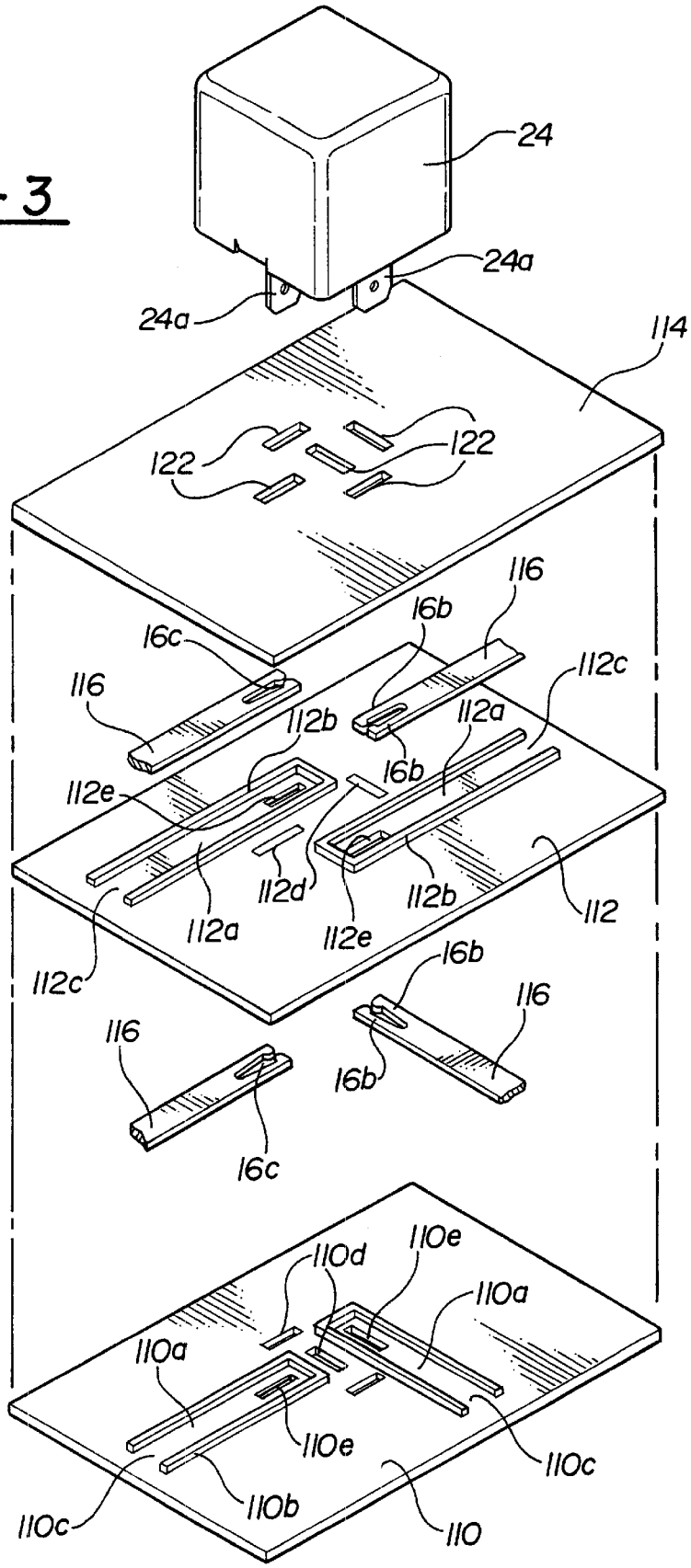
FIG. 3 illustrates a junction box relay mounting arrangement similar to that of FIGS. 1 and 2, but provided with flat press-fit terminals according to the present invention and thereby eliminating the relay pedestal, adapter, and jumper structure.

FIG. 2 illustrates the insulation plates, terminals, inner cover, and pluggable components of FIG. 1 assembled by vertically stacking or sandwiching and plugging them together in a manner well-known in the art. The assembled pieces have a total height of $H_1$ which is often undesirably tall for increasingly compact and crowded vehicle applications. Referring now to FIG. 3, a junction box busbar terminal arrangement similar to that in FIG. 1 is illustrated, but differing in several important respects due to the use of inventive flat (horizontal) press-fit terminals 116. Flat terminals 116 have terminal ends similar to the terminal ends of vertical press-fit terminal 16 in FIGS. 1 and 2, except that prongs 16*b* and slot 16*c* are horizontally disposed on their insulation plates. Unique to the present invention are both the use of flat (horizontal) terminals and the recognition and adaptation of the vertical terminal ends to flat terminal use.

Flat terminals 116 are mounted directly on the flat surfaces of one or more insulation plates 110, 112, using terminal placement channels 110*a*, 112*a* defined by raised rib structure 110*b*, 112*b* and preferably having open ends 110*c*, 112*c*. As shown, the vertical height of the rib structures is only slightly greater than the thickness of the terminals which fit within them.

Unlike the vertical terminal structure of FIGS. 1 and 2, the open ends 110*c*, 112*c* of the terminal placement channels in FIG. 3 do not terminate at the edges of the insulation plates, but may terminate interiorly of the insulation plate edges since the present invention reduces or eliminates the need for peripheral jumper connections between plate-separated layers of busbars.

The invention achieves this elimination of traditional jumper connections by significantly reducing the overall height of the stacked junction box assembly (compare the height $H_2$ of FIG. 5 with the much greater height $H_1$ of prior art FIG. 2). Flat terminals 116, and in particular the horizontal terminal ends have been found to readily accept vertical component terminals such as 24*a* in a secure mechanical and electrical connection without the need for terminal adapter structure such as female-female adapters 18 shown in FIG. 1. This also results in the elimination of the need for a relay pedestal 20 whose function was primarily to house adapters 18. Instead of pedestal and adapter structure 18, 20, cover plate 114 in FIG. 3 requires only the appropriate number of simplified terminal receptacles 122 for admitting terminals 24*a*.

The reduced overall height of the junction box assembly means that vertical component terminals 24*a* from the pluggable component 24 can extend through several stacked layers of busbar terminals and insulation plates. The illustrated embodiment of the invention shown in FIG. 3 advantageously adapts the terminal ends of flat terminals 116 and their respective placement channels with jumper passages 110*e*, 112*e*; passages 110*e*, 112*e* admit vertical component terminals 24*a* therethrough to electrically interconnect one or more busbar layers in the manner of a jumper. Thus, pluggable component terminals 24*a* are advantageously used as the jumper structure, without the need for additional peripheral connections.

Alternately, where one or more insulation busbar layers do not require a jumper interconnection, terminals 24*a* can pass through slots such as 110*d*, 112*d* outside terminal placement channels 110*a*, 112*a*. By appropriately locating terminal placement channels and terminal through-slots in successive insulation plate layers, pluggable component terminals 24*a* can independently interconnect different combinations of layers as required by the junction box circuitry. For example, one set of terminals 24*a* can jumper-connect successive insulation plate layers 110, 112, while another set of terminals 24*a* can jumper-connect insulation plate 112 and a further insulation plate (not shown) beneath plate 110.

Figure 6:
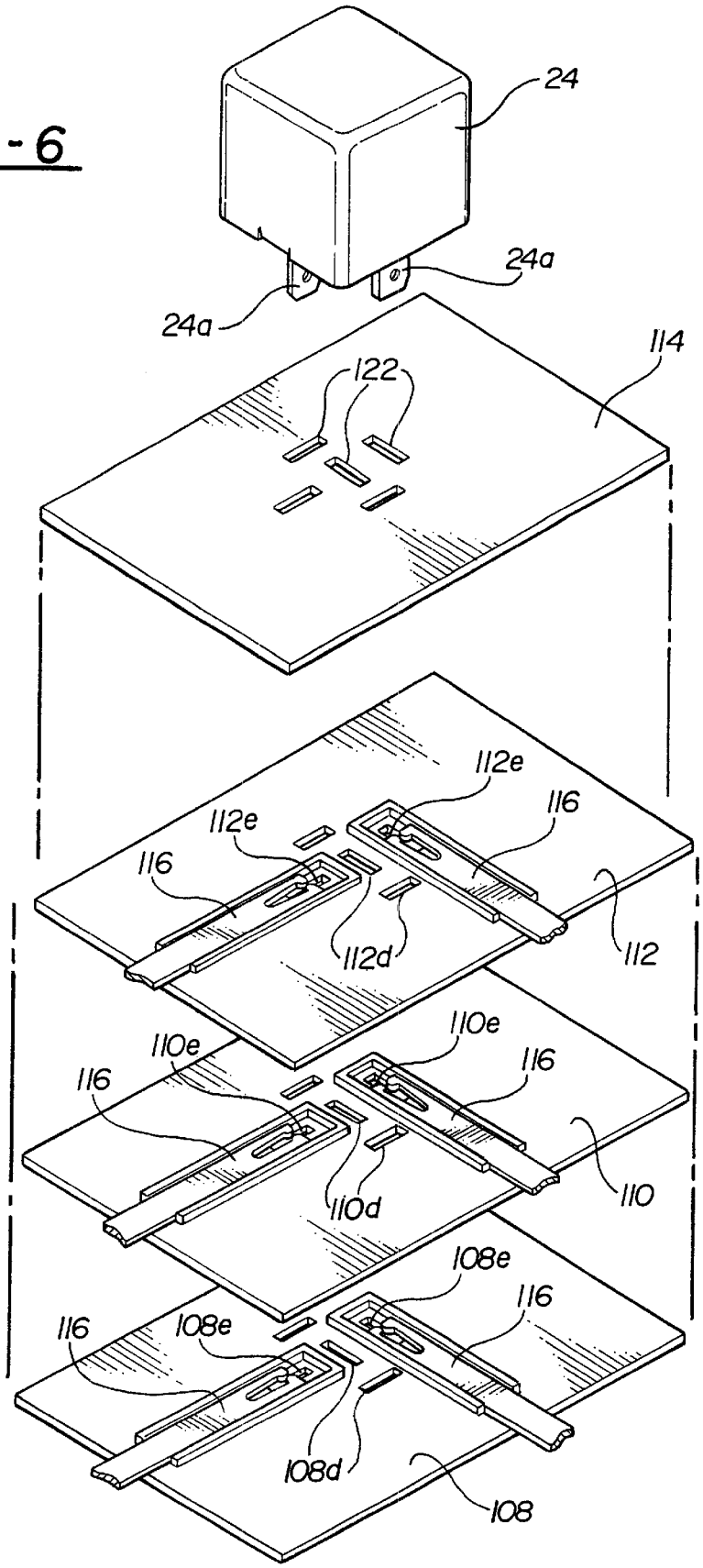
FIG. 6 represents a multi-layer junction box plate arrangement with multiple-level press-fit terminals according to the invention, arranged so that the vertical blades of a pluggable component act as "jumpers" between various levels.

FIG. 6 illustrates an alternate junction box busbar terminal arrangement, with an additional, lowermost insulation plate 108. Flat press-fit terminals 116 on insulation plate layers 112, 110, and 108 are in axial alignment such that terminals 24*a* from pluggable components 24 extend through all three sets of terminals 116 to establish a jumper connection between them. FIG. 6*a* is a cross-sectional view of the components of FIG. 6 assembled, better illustrating the multi-layer jumper connection.

Referring next to FIGS. 7 and 7A, the difference between using prior art vertical terminal structure (FIG. 7) and the present invention (FIG. 7A) is illustrated in side-by-side fashion. The flat press-fit terminals of the invention allow the elimination of pedestal structure 220 and its internal terminal adapter structure so that pluggable component 224 (in the illustrated embodiment a relay of some type) can be mounted directly to the inner cover 214 through simplified terminal receptacles 222.

FIGS. 8 and 8A show similar advantages in using the inventive flat press-fit terminals with pluggable fuse components 324. The typical fuse "pedestal" or receptacle 320 and its internal terminal structure are eliminated in favor of a simple set of terminal receptacles 322 in cover 314.

FIG. 9 illustrates five different embodiments of flat press-fit terminals according to the present invention, including the standard two-prong version illustrated in FIGS. 3 through 6. The beveled, enclosed-slot embodiment denoted at reference number 516 is currently the preferred embodiment because of the ease of insertion of flat, blade-like component terminals and the positive quality of the connection. However, it will be apparent to those skilled in the art that not only those terminal structures illustrated in FIG. 9, but many others will be suitable for use in the present invention provided that the terminal structure rests in an essentially flat, horizontal fashion upon its associated insulation plate. The prong and/or slot structure for accepting component terminals therethrough can vary widely provided a satisfactory electrical connection (and in some cases mechanical connection) is maintained.

It will be apparent to those skilled in the art that while the term "junction box" has been used throughout as the exemplary terminal-containing structure with which the present invention is illustrated, similar devices such as power distribution centers (PDC), power distribution boxes (PDB), bussed electrical centers (BEC) and other busbar terminal-using circuitry junctions are included in the definition and can employ the present invention. These and other modifications will be apparent to those skilled in the art now that we have illustrated examples of our invention. Accordingly,

We claim:

1. An assembly for receiving a vertical terminal from a pluggable junction box component in an electrical connection comprising:

a first flat busbar terminal disposed in flat coplanar fashion directly on a face of an essentially planar first insulation plate, the first terminal having a slot for directly receiving a vertical terminal from a pluggable junction box component in an electrical connection, the first insulation plate including a terminal-receiving aperture aligned with at least a portion of the terminal slot; and an essentially flat second insulation plate beneath the first insulation plate, the second insulation plate having a second flat busbar terminal disposed in flat coplanar fashion directly on a face of the second insulation plate and having an integral rib partially surrounding and conforming to the terminal and having a height only slightly greater than the thickness of the terminal, the first and second plates being disposed in stacked relationship with a distance between them being defined by the height of the raised rib to provide the assembly with a significantly reduced height, wherein the second flat terminal on the second insulation plate at least partially underlies the first flat terminal on the first insulation plate such that the vertical terminal from the pluggable junction box component extends through the first flat terminal and first insulation plate into electrical connection with the second flat terminal when the second terminal is disposed within the rib and the vertical terminal passes through the second flat terminal, thereby establishing a jumper connection between the first and second flat terminals on the first and second insulation plates.

2. The apparatus of claim 1, wherein the terminal slot is open at an end of the first terminal.

3. The apparatus of claim 2, wherein the terminal slot is defined by two resilient arms or prongs at the end of the first terminal.

4. The apparatus of claim 1, wherein the terminal slot is enclosed in an intermediate portion of the terminal.

5. An insulation plate and busbar terminal assembly for use in a vehicle junction box, comprising:

a flat cover having a plurality of apertures formed therein to define a receptacle for vertical terminals of a pluggable junction box component;

a plurality of essentially flat insulation plates secured to an underside of the cover in stacked fashion wherein a distance between the stacked plates is not substantially greater than a thickness of a busbar terminal, two or more of the insulation plates including one or more flat busbar terminals mounted in flat coplanar fashion directly to a flat face of the two or more flat insulation plates, the flat busbar terminals having slotted portions for receiving the vertical terminals from the component therethrough in an electrical connection and further wherein at least two of the. insulation plates in the stacked fashion include flat busbar terminals which are aligned to receive the vertical terminal from the pluggable component therethrough to form a jumper connection between the at least two insulation plates, wherein the insulation plates each comprises a terminal placement channel each defined by a raised rib having a height slightly greater than the thickness of the flat busbar terminal; and wherein the terminal placement channels have an open end through which the flat busbar terminal can be inserted and removed in a direction parallel to the insulation plate.

* * * * *